US005749779A

United States Patent [19]

Wilburn et al.

[11] Patent Number: 5,749,779

[45] Date of Patent: May 12, 1998

[54] MOVABLE OVERHEAD VENTILATION ASSEMBLY AND FILTERING METHOD

[75] Inventors: Donald William Wilburn; Gary Francis Faiello, both of Monroe, N.C.

[73] Assignee: Wilburn's Body Shop, Inc., Charlotte, N.C.

[21] Appl. No.: 552,462

[22] Filed: Nov. 9, 1995

[51] Int. Cl.[6] ..... B05B 15/00

[52] U.S. Cl. ..... 454/65; 55/471; 454/67

[58] Field of Search ..... 454/49, 63, 64, 454/65, 67; 55/471, 472

[56] References Cited

U.S. PATENT DOCUMENTS

| | | | |
|---|---|---|---|
| 1,977,386 | 10/1934 | Holes | 454/65 X |
| 2,761,373 | 9/1956 | Owen . | |
| 2,829,582 | 4/1958 | Abbott et al. | 454/64 |
| 3,096,933 | 7/1963 | Bora . | |
| 3,520,244 | 7/1970 | Gaines, Jr. . | |
| 3,879,957 | 4/1975 | Wilson et al. . | |
| 3,913,470 | 10/1975 | Cullen . | |
| 3,926,104 | 12/1975 | El Dorado | 454/65 |
| 4,012,922 | 3/1977 | Falensky . | |
| 4,315,458 | 2/1982 | Hudson, III . | |
| 4,549,472 | 10/1985 | Endo et al. . | |
| 4,553,992 | 11/1985 | Boissinot et al. | 454/67 X |
| 4,660,465 | 4/1987 | Jentzsch et al. | 454/65 |
| 4,714,010 | 12/1987 | Smart . | |
| 5,097,750 | 3/1992 | Oldham et al. | 454/63 |
| 5,263,897 | 11/1993 | Kondo et al. | 454/189 |
| 5,487,766 | 1/1996 | Vannier | 454/64 X |

FOREIGN PATENT DOCUMENTS

| | | | |
|---|---|---|---|
| 1-118049 | 5/1989 | Japan | 454/67 |
| 546289 | 7/1942 | United Kingdom | 454/65 |

*Primary Examiner*—Harold Joyce
*Attorney, Agent, or Firm*—W. Thad Adams, III, P.A.

[57] ABSTRACT

A movable overhead ventilation assembly is provided for use in a work facility to be positioned in close proximity to a source of airborne environmental material. The ventilation assembly includes a supporting frame located within the work facility. The frame includes a longitudinally-disposed overhead track. A movable chassis is carried by the track. A ventilation housing is carried by the chassis for overhead translational movement of the ventilation housing within the work facility. The ventilation housing includes a plurality of walls, and has at least two openings therein defining respective inlet and outlet zones thereof. An exhaust fan is located within the ventilation housing between the inlet zone and the outlet zone for creating an upwardly moving air stream in the area surrounding the source of airborne environmental material. A filtration medium is positioned between the inlet zone and the fan of the ventilation housing for capturing and separating material entrained in the upwardly moving air stream as the air stream enters the ventilation housing through the inlet zone and exits through the outlet zone. A drive wheel moves the chassis along the track within the work facility.

14 Claims, 5 Drawing Sheets

MOVABLE OVERHEAD VENTILATION ASSEMBLY AND FILTERING METHOD

TECHNICAL FIELD AND BACKGROUND OF THE INVENTION

This invention relates to a movable overhead ventilation assembly and filtering method. The invention is particularly useful in a substantially enclosed work environment, such as an automobile body shop where automobiles are repaired, trimmed, and primed before being repainted and returned to their owner. During trimming and priming, airborne environmental materials, such as dust, metal fragments, and priming solution, are broadcast into an area surrounding the automobile, and present a potentially hazardous condition to nearby workers. Long term exposure to such conditions can lead to health problems, such as lung and other respiratory disorders.

Unlike an automobile paint room, the body shop typically does not include adequate means for filtering out airborne environmental materials, and controlling the quality of air within the facility. Presently, some workers are required and others voluntarily choose to wear respirators in an effort to prevent inhaling this unclean air. Although respirators provide a certain degree of health protection, they are generally uncomfortable to the worker, and are often not used consistently during work. Furthermore, respirators do nothing to improve the quality of air within the facility.

Conventional air filtering devices and methods are likewise inadequate for use in many automobile body shops. Such devices are generally mounted in a fixed location within the facility, and do not properly filter the air surrounding a particular automobile during trimming and priming. In order to effectively service the entire body shop, numerous stationary fans and a large amount of space would be required. This would greatly increase the noise level within the body shop, and result in wasted, costly electrical power.

In other cases, before trim work and priming, automobiles are moved to a designated area within the body shop where a stationary exhaust fan or other filtering means are located. This procedure is grossly inefficient, time consuming, and generally creates a backlog of automobiles waiting to be trimmed and primed.

The ventilation assembly of the present invention addresses these and other related problems by providing a single, movable overhead assembly which can service the entire work facility in an effective and efficient manner without occupying substantial space within the facility. The invention separates dangerous airborne material from the air immediately surrounding an automobile being repaired, and returns clean air into the work facility. The invention is supported approximately 7 feet above the floor of the facility, and is readily moveable between various work stations as needed to service a number of automobiles being trimmed or primed below. Furthermore, the invention is moveable overhead in both a lengthwise and widthwise dimension of the facility.

SUMMARY OF THE INVENTION

Therefore, it is an object of the invention to provide a ventilation assembly which creates an air stream in the immediate area of an automobile, which effectively and efficiently separates dangerous airborne material from the air stream, and which returns clean air into the work facility.

It is another object of the invention to provide a ventilation assembly which includes a ventilation housing supported for overhead movement within the work facility.

It is another object of the invention to provide a ventilation assembly which includes a ventilation housing moveable in an "X" direction along a widthwise dimension of the facility, and in a "Y" direction along a lengthwise dimension of the facility.

It is another object of the invention to provide a method of creating a moving air stream in the immediate area surrounding an automobile, separating airborne environmental material entrained in the air stream, and then returning clean air into the work facility.

These and other objects of the present invention are achieved in the preferred embodiments disclosed below by providing a movable overhead ventilation assembly for use in a work facility to be positioned in close proximity to a source of airborne environmental material. The ventilation assembly includes a supporting frame located within the work facility. The frame includes longitudinally-disposed overhead track means. A movable is carried by the track means. A ventilation housing is carried by the chassis for overhead translational movement of the ventilation housing within the work facility. The ventilation housing includes a plurality of walls, and has at least two openings therein defining respective inlet and outlet zones thereof.

Air movement means are located within the ventilation housing between the inlet zone and the outlet zone for creating an upwardly moving air stream in the area surrounding the source of airborne environmental material. A filtration medium is positioned between the inlet zone and the air movement means of the ventilation housing for capturing and separating material entrained in the upwardly moving air stream as the air stream enters the ventilation housing through the inlet zone and exits through the outlet zone. Ventilation housing movement means are provided for moving the chassis along the track means within the work facility.

According to one preferred embodiment of the invention, the track means includes first and second spaced-apart longitudinally extending support rails.

According to another preferred embodiment of the invention, the ventilation housing movement means includes a drive wheel attached to the chassis and engaging one of the first and second support rails. A motor is connected to the drive wheel for actuating the drive wheel to move the ventilation housing along the length of the first and second support rails.

According to yet another preferred embodiment of the invention, adjustable mounting means are provided for mounting the ventilation housing on the chassis and allowing adjustable movement of the ventilation housing along the chassis in a lateral direction perpendicular to the direction of the first and second support rails.

According to yet another preferred embodiment of the invention, a pull cord is attached to the ventilation housing for being manually pulled by a user to move the ventilation housing along the chassis to adjust the position of the ventilation housing relative to the first and second support rails.

According to yet another preferred embodiment of the invention, the ventilation housing includes a plurality of attached side walls, a top wall, and an open bottom. The filtration medium is positioned in filtering relation to the open bottom of the ventilation housing.

According to yet another preferred embodiment of the invention, the air movement means includes an exhaust fan located between the filtration medium and the top wall of the ventilation housing.

According to yet another preferred embodiment of the invention, the top wall of the ventilation housing includes an enlarged hood positioned upon the attached side walls of the ventilation housing. The hood cooperates with the side walls to define a plurality of side openings in the ventilation housing for exhausting the filtered air stream outwardly from the ventilation housing.

According to yet another preferred embodiment of the invention, a cone-shaped air diffuser is located adjacent to an interior surface of the hood for directing the upwardly moving air stream outwardly towards an outer periphery of the hood and through the side openings of the ventilation housing.

According to yet another preferred embodiment of the invention, a plurality of angled baffles are attached to respective side walls of the ventilation housing adjacent to the side openings defined therein to exhaust the filtered air stream outwardly from the ventilation housing and away from an area directly beneath the ventilation housing.

According to yet another preferred embodiment of the invention, the filtration medium is a polyester mesh filter mat.

According to yet another preferred embodiment of the invention, the ventilation housing includes a pair of spaced-apart, laterally disposed light fixtures.

An embodiment of the method according to the invention comprises the steps of locating a movable overhead ventilation housing in close proximity above a source of airborne environmental material. The ventilation housing has a plurality of walls and at least two openings therein defining respective inlet and outlet zones thereof. An upwardly flowing air stream is generated in an area surrounding the source of airborne environmental material. The moving air stream is conveyed upwardly into the ventilation housing. Environmental material entrained in the moving air stream is captured and separated as it enters the ventilation housing through the inlet zone and exits through the outlet zone. The ventilation housing is then moved within the work facility to be positioned above a second source of airborne environmental material.

According to one preferred embodiment of the invention, the step of capturing and separating environmental material includes the step of positioning a filtration medium within the ventilation housing in filtering relation to the fluid inlet zone thereof.

According to another preferred embodiment of the invention, the ventilation housing moving step includes the step of moving the ventilation housing along a lengthwise dimension of the work facility, and in a perpendicular direction along a widthwise dimension of the work facility.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
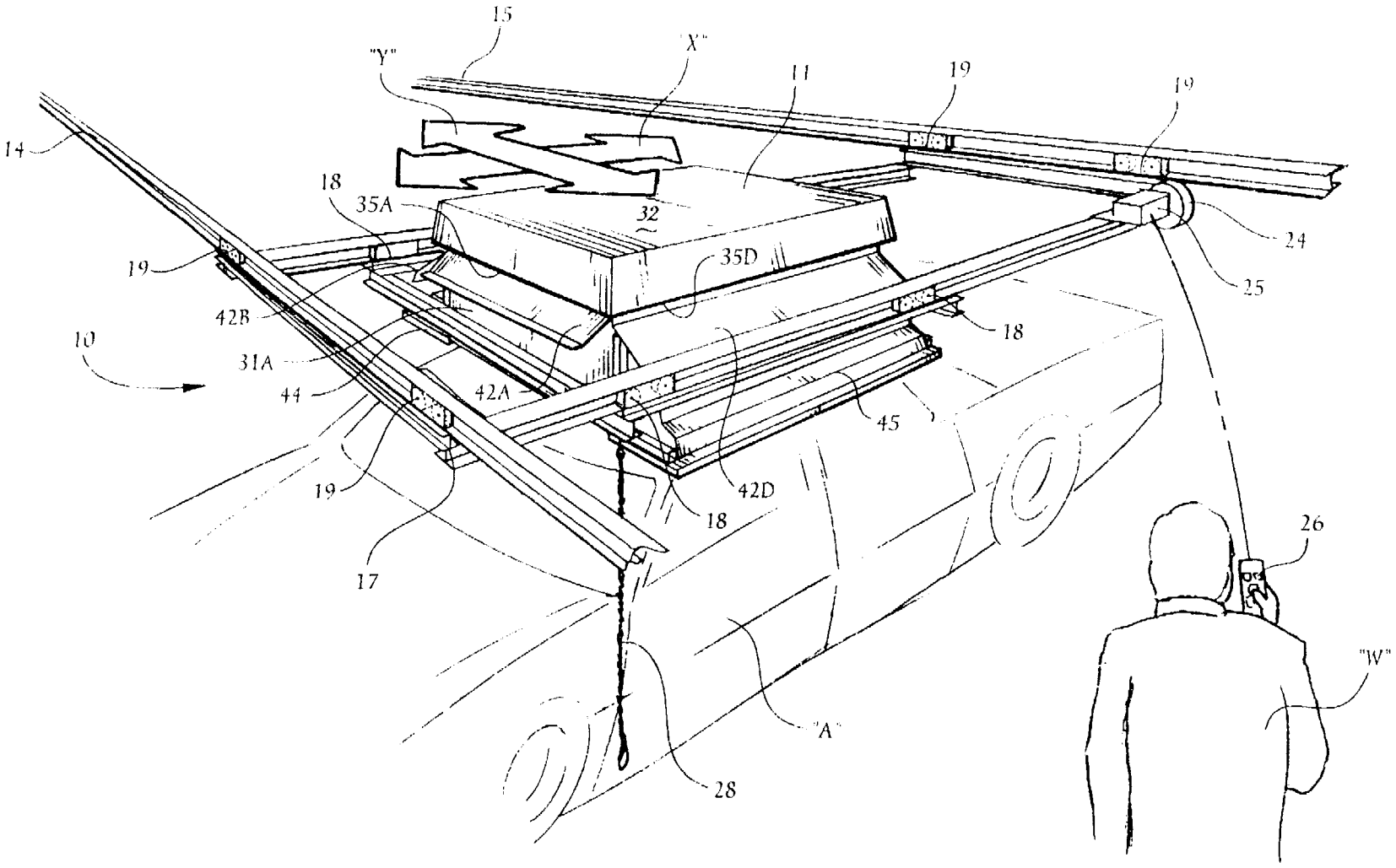
FIG. 1 is an environmental perspective view of the overhead ventilation assembly according to one preferred embodiment of the invention.
Figure 2:
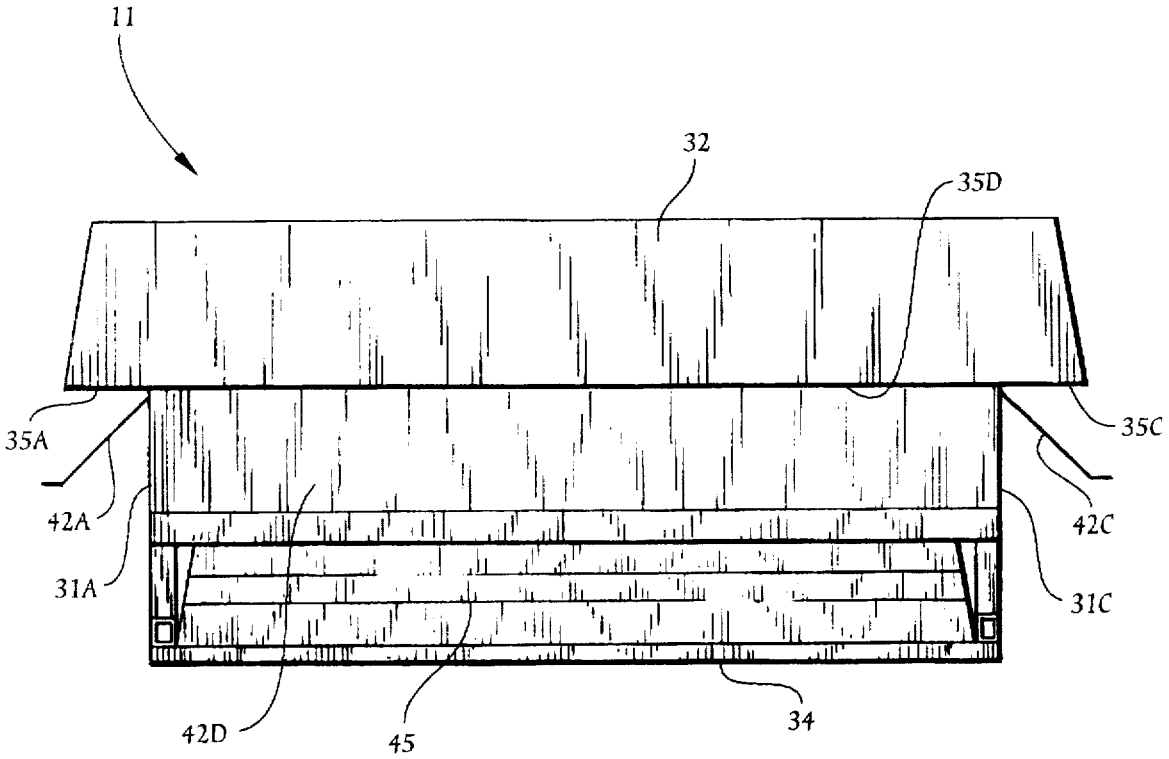
FIG. 2 is a side elevational view of the housing of the ventilation assembly.
Figure 3:
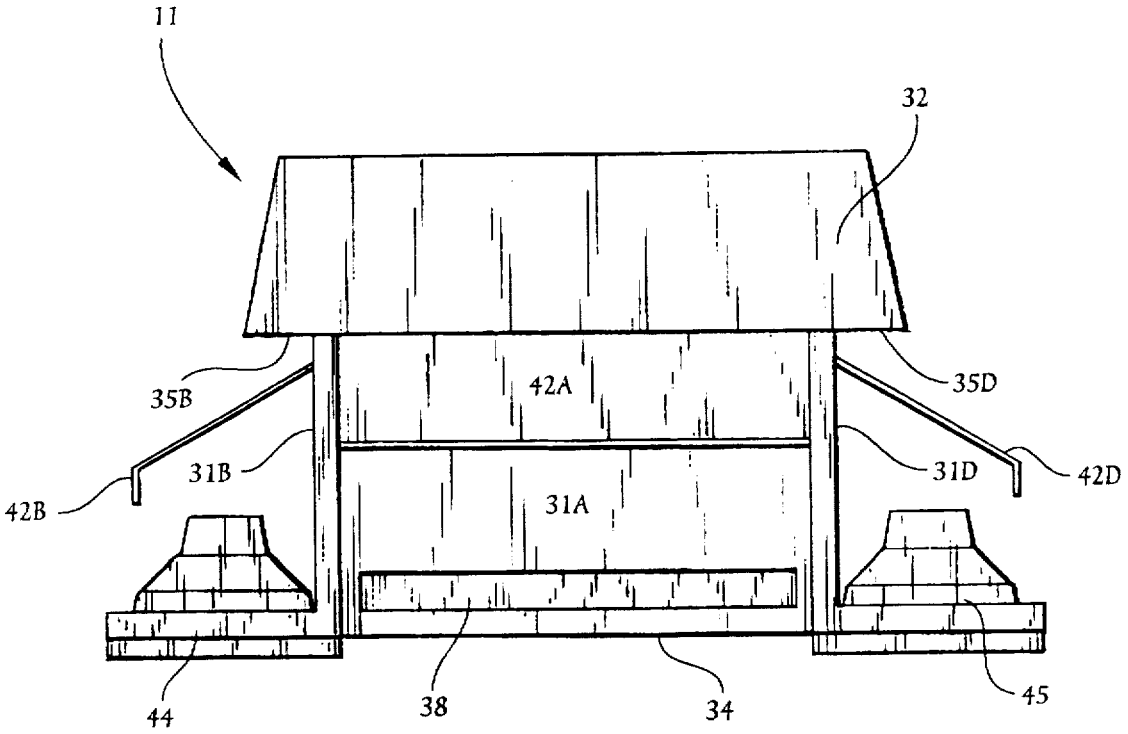
FIG. 3 is an end elevational view of the housing of the ventilation assembly.
Figure 4:
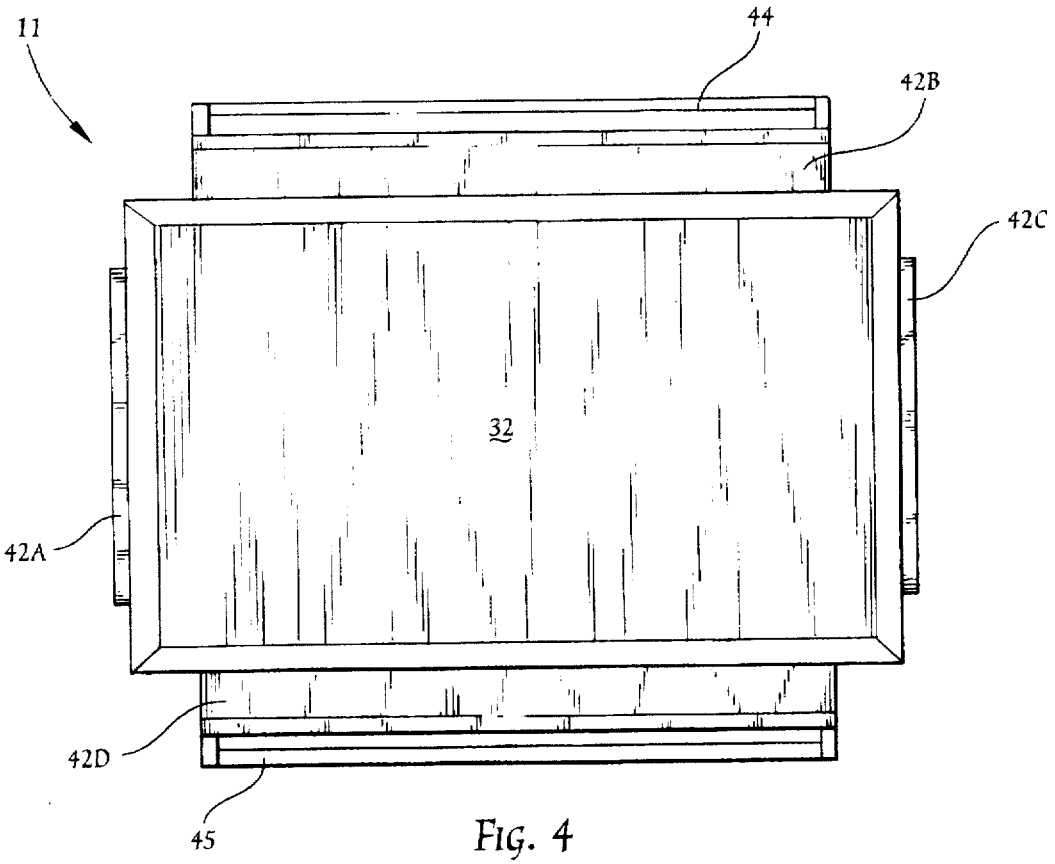
FIG. 4 is a top plan view of the housing of the ventilation assembly.
Figure 5:
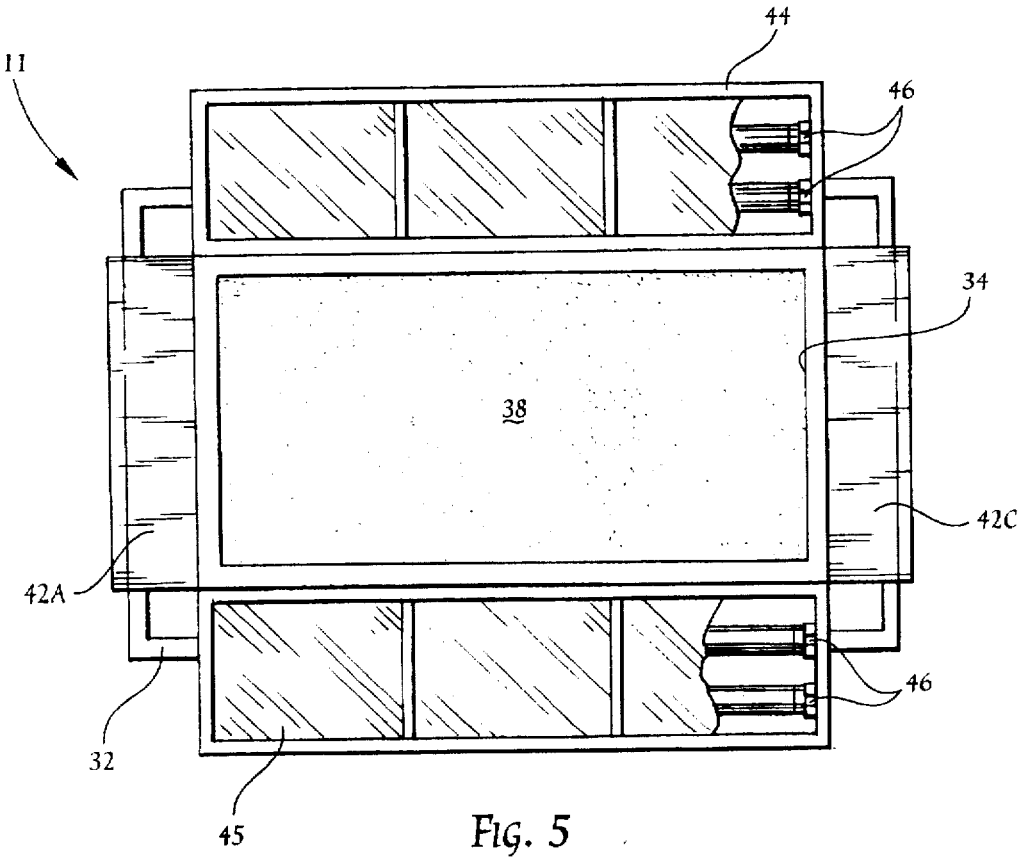
FIG. 5 is a bottom plan view of the housing of the ventilation assembly.

Referring now specifically to the drawings, a movable overhead ventilation assembly according to the present invention is illustrated in FIG. 1 and shown generally at reference numeral 10. The ventilation assembly 10 is particularly useful in a substantially enclosed work environment, such as an automobile body shop where automobiles are repaired, trimmed, and primed before being repainted. The ventilation assembly 10 creates an upwardly moving air stream in an immediate area surrounding the automobile "A", separates hazardous airborne material, such as paint chips, metal fragments, priming solution, and other particulate matter from the moving air stream, and then returns clean air into the area of the automobile "A" and work facility.

As shown in FIG. 1, the ventilation assembly 10 includes a ventilation housing 11 mounted on a pair of spaced-apart, overhead support rails 14 and 15 extending between end walls of the work facility. The support rails 14 and 15 are suspended from ceiling joists or other suitable structure, and preferably span the entire length of the work facility. According to one embodiment, the length of support rails 14 and 15 is approximately 100 feet, and the spacing between the support rails 14 and 15 is approximately 25 feet. The area defined by the length and spacing of the support rails 14 and 15 accommodates between 8–10 work stations for trimming and priming automobiles "A". The ventilation housing 11 of the ventilation assembly 10 is movable from station to station, and resides approximately 2–4 feet above the automobile "A" during processing.

The ventilation housing 11 includes a chassis 17 carried by the support rails 14 and 15, and a plurality of rollers 18 for permitting lateral sliding movement of the ventilation housing 11 along the length of the chassis 17 in a direction perpendicular to the direction of the support rails 14 and 15. This direction of movement is defined herein as movement in the "X" direction.

The chassis 17 likewise includes rollers 19 at opposite ends thereof for engaging the support rails 14 and 15, and permitting sliding movement of the chassis 17 and ventilation housing 11 along the length of the support rails 14 and 15. This direction of movement is defined herein as movement in the "Y" direction. Direction arrows shown in FIG. 1 indicate the X-Y movement of the ventilation housing 11 within the work facility.

A drive wheel 24 is attached to the chassis 17, and frictionally engages one of the support rails 14 and 15 for moving the ventilation housing 11 in the "Y" direction. The drive wheel 24 is actuated by a low-geared winch motor 25 mounted on the chassis 17, and including a hand-held control device 26 for use by a worker "W" to command operation of the motor 25. According to one embodiment, the winch motor 25 has a gear ratio of 148/1, and runs off a 12 volt DC rechargeable battery. Preferably, a battery charger is located adjacent to the motor 25, and is readily accessible for recharging the battery.

Preferably, the drive wheel 24 and motor 25 provide automatic forward and rearward movement of the chassis 17 and ventilation housing 11 at a relatively slow speed, thereby enabling the worker "W" to more effectively control the movement of the ventilation housing 11 as it travels overhead along the support rails 14 and 15. The ventilation housing 11 is preferably movable at a speed of about 1–2 ft/sec. In addition, a pull cord 28 is attached to the ventilation housing 11, and is readily accessible by the worker "W" for manually adjusting the positioning of the ventilation housing 11 in the "X" direction between the support rails 14 and 15.

DESCRIPTION OF VENTILATION HOUSING 11

Referring now to FIGS. 2–5, the ventilation housing 11 includes attached side walls 31A–31D, an enlarged top hood 32, and an open bottom 34. The top hood 32 is mounted on the attached side walls 31A–31D by brackets or other suitable means, and cooperates with the side walls 31A–31D to define respective exhaust openings 35A–35D in the ventilation housing 11. An exhaust fan 36 is positioned between the open bottom 34 and top hood 32 of the ventilation housing 11 for generating an upwardly moving stream of air. According to one embodiment, the exhaust fan 36 has 30-inch diameter cast aluminum blades, and is powered by a 1725 RPM, 115V, 60 Hz, totally enclosed, hazardous location, ball bearing, split-phase motor. The free air delivery of the exhaust fan 36 is 7185 CFM.

The open bottom 34 of the ventilation housing 11 defines an air inlet zone through which the upwardly moving, fan-generated air stream enters the ventilation housing 11. The air stream is entrained with airborne environmental materials resulting from the trimming and priming of the automobile "A". As mentioned above, long term exposure to such materials in inadequately ventilated areas is potentially hazardous to the health of workers.

Figure 6:
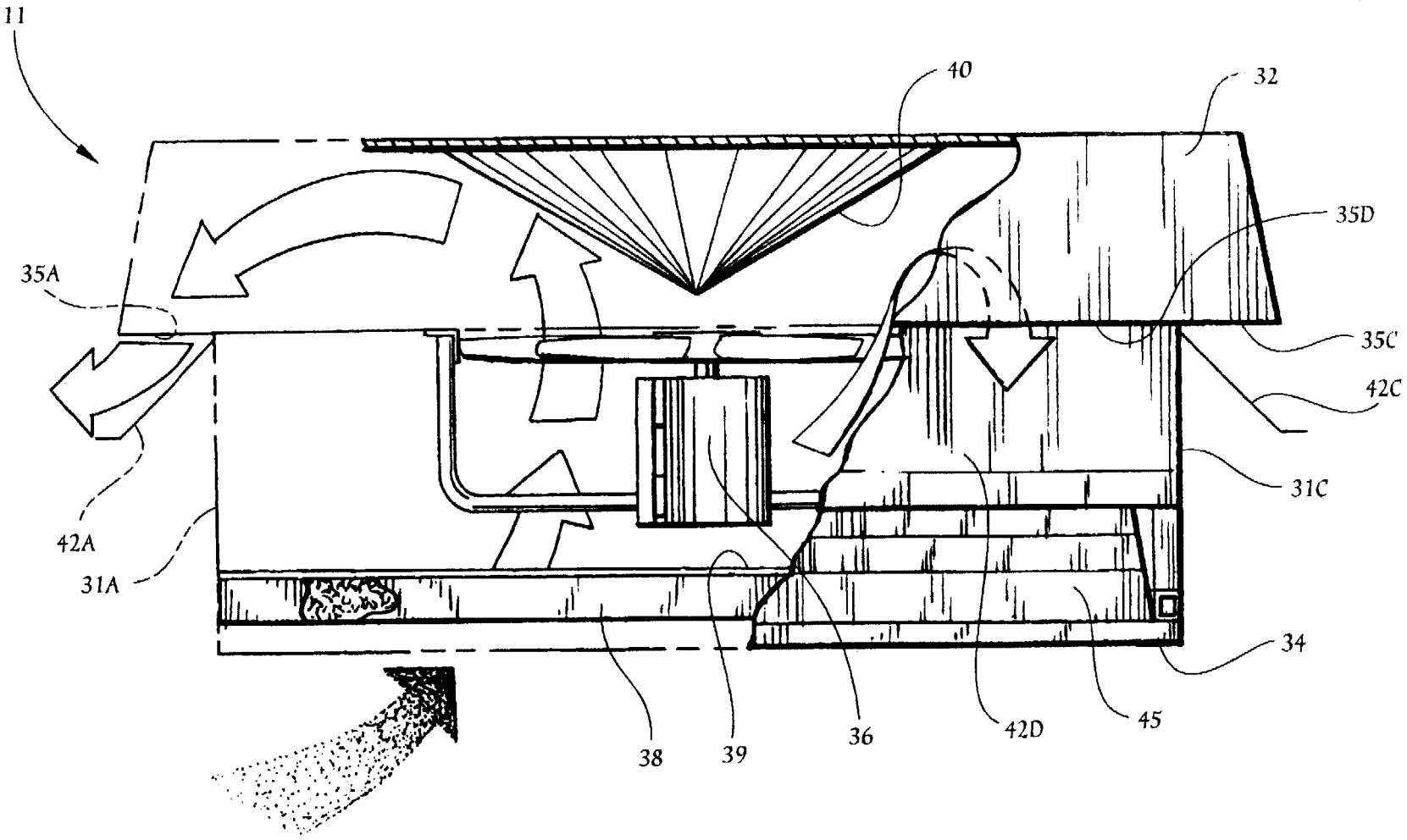
FIG. 6 is a side elevational view of the housing with portions of the housing walls removed and shown in phantom to illustrate the interior elements of the housing, and to show the direction of movement of the air stream as it passes through the housing.
Figure 7:
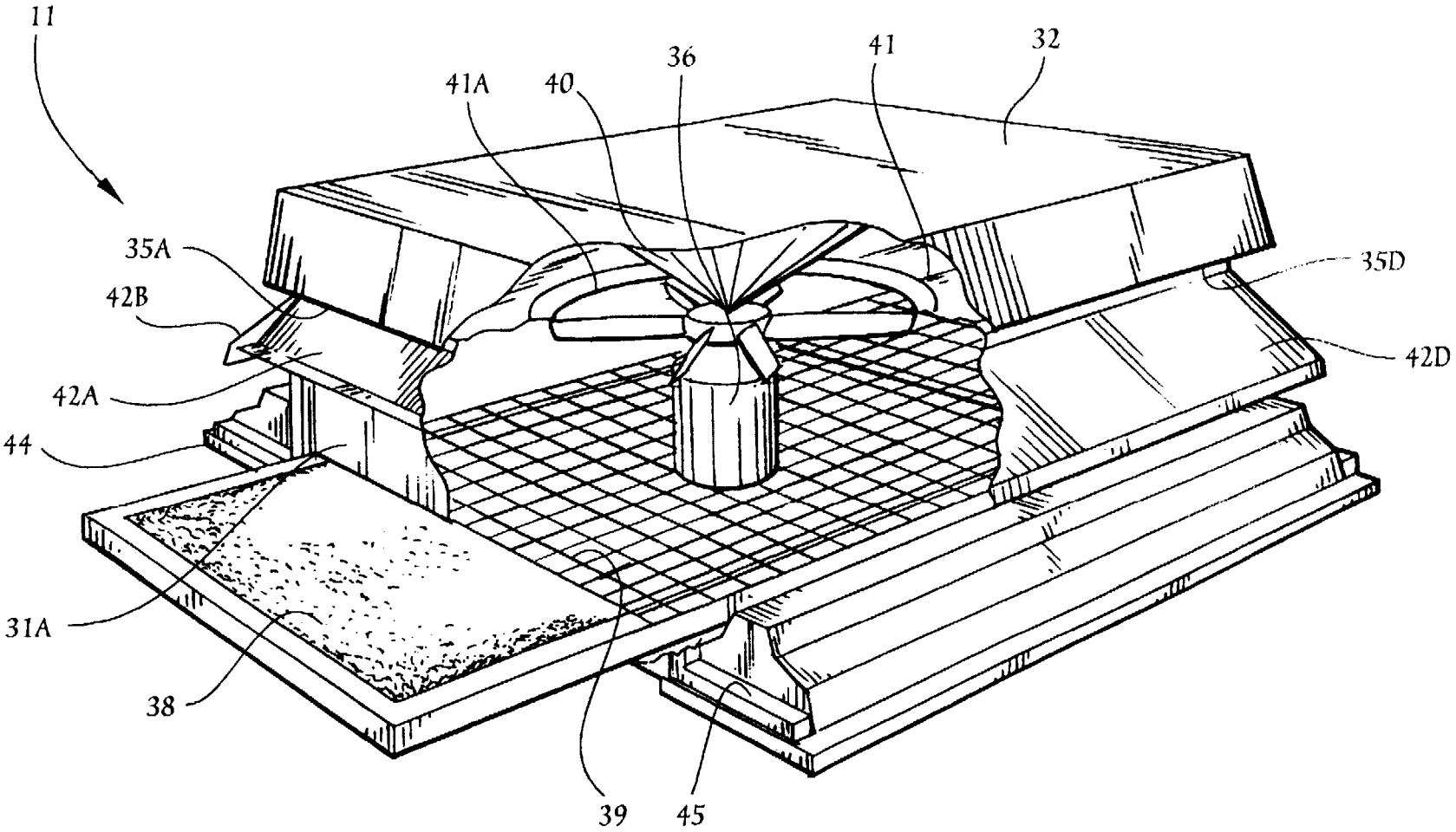
FIG. 7 is a perspective view of the housing with portions of the housing walls removed, and showing the filtration medium moved slightly outwardly from the open bottom of the housing.

As best shown in FIGS. 6 and 7, a filtration medium 38 is removably positioned within the ventilation housing 11 to cover the open bottom 34, and to separate the airborne environmental materials entrained in the air stream as it enters the ventilation housing 11 through the open bottom 34. According to one embodiment, the filtration medium 38 is a three-quarter inch thick polyester or fiberglass mesh filter mat. In addition, a wire backing 39 may be located adjacent to the filtration medium 38 to prevent a worker from inadvertently contacting the rotating blades of the exhaust fan 36 when replacing the filtration medium 38.

The exhaust fan 36 pulls the moving air stream upwardly through the filtration medium 38, and exhausts it against a cone-shaped air diffuser 40 secured to an inside surface of the enlarged hood 32. The diffuser 40 urges the filtered air stream outwardly towards the outer perimeter of the hood 32 where the air stream exits the ventilation housing 11 through the exhaust openings 35A–35D. To increase the outward flow of filtered air, an intermediate wall 41 is located adjacent to the fan 36, and includes a circular opening 41A therein of sufficient diameter to accommodate the rotating blades of the fan 36.

The exhaust openings 35A–35D collectively define an air outlet zone through which clean air is returned into the work facility. The direction of filtered air flow outwardly from the housing 11 is indicated in FIG. 6. Angled baffles 42A–42D are attached to the side walls 31A–31D of the ventilation housing 11, and are located respectively beneath the exhaust openings 35A–35D to direct the filtered air stream away from the area directly beneath the ventilation housing 11 and automobile "A" being processed.

Preferably, the ventilation housing 11 further includes first and second light fixtures 44 and 45 located on respective sides of the ventilation housing 11 for illuminating the work station. Each light fixture 44 and 45 includes a pair of laterally disposed fluorescent bulbs 46. The required electricity for the light fixtures 44 and 45 and exhaust fan 36 may come from any suitable source such as an overhead power supply cord extendable to reach preselected electrical outlets located within the work facility.

OPERATION OF VENTILATION ASSEMBLY 10

As previously discussed, the ventilation assembly 10 is particularly useful in the repair, trimming, and priming of automobiles "A" within a substantially enclosed work facility, such as an automobile body shop. A typical body shop may include between 8–10 open work stations. The work stations are located beneath the support rails 14 and 15, and within an open area defined by the length of the rails and spacing between the rails. A single automobile "A" is generally positioned in each work station, and preferably remains in its work station during the body repair, trimming, and priming processes.

Since use of the ventilation assembly 10 is not required in each station at all times, a single ventilation assembly 10 may be used to service the entire body shop. For example, in one or more work stations, damaged body panels may be repaired and replaced before any necessary trim work or priming is preformed on the automobiles "A". The ventilation assembly 10 is not generally required during this procedure in these stations. In another station, an automobile "A" may be ready for priming. The ventilation housing 11 of the ventilation assembly 10 is thus moved along the support rails 14 and 15 in the "Y" direction by the worker "W" using the hand-held control device 26 to position the housing 11 in an area above the automobile "A", as shown in FIG. 1. The pull cord 28 is then used to adjust the positioning of the ventilation housing 11 in the "X" direction to locate the housing 11 directly over the particular area of the automobile "A" being primed. When priming is completed, the worker "W" again uses the control device 26 to move the ventilation housing 11 to another work station where an automobile "A" is ready for trimming or priming.

A movable overhead ventilation assembly and filtering method are described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A movable overhead ventilation assembly for use in a work facility to be positioned in close proximity to a source of airborne environmental material, said ventilation assembly comprising:

(a) a supporting frame located within the work facility, and comprising longitudinally-disposed overhead track means;

(b) a movable chassis carried by said track means;

(c) a ventilation housing carried by said chassis for overhead translational movement of said ventilation housing within the work facility, said ventilation housing including an open bottom defining an air inlet zone thereof, a plurality of attached side walls, and an enlarged top hood positioned on the side walls and cooperating with the side walls to form a plurality of side openings, the side openings collectively defining an air outlet zone of said ventilation housing;

(d) air movement means comprising an exhaust fan located within said ventilation housing between the inlet zone and the outlet zone thereof for creating an upwardly moving air stream in the area surrounding the source of airborne environmental material;

(e) a cone-shaped air diffuser located adjacent to an interior surface of the hood for directing the upwardly moving air stream outwardly towards an outer periphery of the hood and through the side openings of the ventilation housing;

(f) a filtration medium positioned between the inlet zone of said ventilation housing and the exhaust fan for capturing and separating material entrained in the upwardly moving air stream as the air stream enters the ventilation housing through the inlet zone thereof and exits through the outlet zone thereof; and (g) ventilation housing movement means for moving said chassis along said track means within the work facility.

2. An overhead ventilation assembly according to claim 1, wherein said track means comprises first and second spaced-apart longitudinally extending support rails.

3. An overhead ventilation assembly according to claim 2, wherein said ventilation housing movement means comprises a drive wheel attached to said chassis and engaging one of the first and second support rails, and a motor for actuating said drive wheel to move said ventilation housing along the length of said first and second support rails.

4. An overhead ventilation assembly according to claim 2, and including adjustable mounting means for mounting said ventilation housing on said chassis to allow adjustable movement of the ventilation housing along said chassis in a lateral direction perpendicular to the direction of the first and second support rails.

5. An overhead ventilation assembly according to claim 4, and comprising a pull cord attached to said ventilation housing for being manually pulled by a user to move said ventilation housing along said chassis to adjust the position of said ventilation housing relative to the first and second support rails.

6. An overhead ventilation assembly according to claim 1, wherein said filtration medium comprises a polyester mesh filter mat.

7. An overhead ventilation assembly according to claim 1, wherein said ventilation housing includes a pair of spaced-apart, laterally disposed light fixtures.

8. A movable overhead ventilation assembly for use in a work facility to be positioned in close proximity to a source of airborne environmental material, said ventilation assembly comprising:

(a) a supporting frame located within the work facility, and comprising longitudinally-disposed overhead track means;

(b) a movable chassis carried by said track means;

(c) a ventilation housing carried by said chassis for overhead translational movement of said ventilation housing within the work facility, said ventilation housing including an open bottom defining an air inlet zone thereof, a plurality of attached side walls, and an enlarged top hood positioned on the side walls and cooperating with the side walls to form a plurality of side openings, the side openings collectively defining an air outlet zone of said ventilation housing;

(d) air movement means comprising an exhaust fan located within said ventilation housing between the inlet zone and the outlet zone thereof for creating an upwardly moving air stream in the area surrounding the source of airborne environmental material;

(e) a filtration medium positioned between the inlet zone of said ventilation housing and the exhaust fan for capturing and separating material entrained in the upwardly moving air stream as the air stream enters the ventilation housing through the inlet zone thereof and exits through the outlet zone thereof;

(f) a plurality of angled, outwardly extending baffles attached to respective side walls of said ventilation housing adjacent to the side openings of the outlet zone to direct the filtered air stream outwardly away from an area directly beneath said ventilation housing; and (g) ventilation housing movement means for moving said chassis along said track means within the work facility.

9. An overhead ventilation assembly according to claim 8, wherein said track means comprises first and second spaced-apart longitudinally extending support rails.

10. An overhead ventilation assembly according to claim 9, wherein said ventilation housing movement means comprises a drive wheel attached to said chassis and engaging one of the first and second support rails, and a motor for actuating said drive wheel to move said ventilation housing along the length of said first and second support rails.

11. An overhead ventilation assembly according to claim 9, and including adjustable mounting means for mounting said ventilation housing on said chassis to allow adjustable movement of the ventilation housing along said chassis in a lateral direction perpendicular to the direction of the first and second support rails.

12. An overhead ventilation assembly according to claim 11, and comprising a pull cord attached to said ventilation housing for being manually pulled by a user to move said ventilation housing along said chassis to adjust the position of said ventilation housing relative to the first and second support rails.

13. An overhead ventilation assembly according to claim 8, wherein said filtration medium comprises a polyester mesh filter mat.

14. An overhead ventilation assembly according to claim 8, wherein said ventilation housing includes a pair of spaced-apart, laterally disposed light fixtures.

* * * * *